US006335706B1

(12) United States Patent
Elliot

(10) Patent No.: US 6,335,706 B1
(45) Date of Patent: Jan. 1, 2002

(54) METHOD TO FEED ANTENNAS PROXIMAL A MONOPOLE

(76) Inventor: Paul Gordon Elliot, Magnetic Sciences 367, Arlington St., Acton, MA (US) 01720

( * ) Notice: Subject to any disclaimer, the term of this patent is extended or adjusted under 35 U.S.C. 154(b) by 0 days.

(21) Appl. No.: 09/679,032

(22) Filed: Oct. 4, 2000

Related U.S. Application Data

(60) Provisional application No. 60/157,121, filed on Oct. 4, 1999.

(51) Int. Cl.[7] ..... H01Q 21/00
(52) U.S. Cl. ..... 343/727; 343/797
(58) Field of Search ..... 343/700 MS, 727, 343/729, 730, 797, 846, 848

(56) References Cited

U.S. PATENT DOCUMENTS 3,521,284 A * 7/1970 Shelton, Jr. et al. ..... 343/727
3,739,390 A 6/1973 Poppe
3,813,674 A 5/1974 Sidford
3,945,013 A 3/1976 Brunner et al.
3,952,310 A 4/1976 Griffee et al.
4,062,017 A * 12/1977 Thompson ..... 343/722
4,814,777 A 3/1989 Monser
5,220,334 A * 6/1993 Raguenet et al. ..... 343/700 MS
5,264,862 A 11/1993 Kumpfbeck
5,313,218 A 5/1994 Busking
5,793,337 A * 8/1998 Schenkyr et al. ..... 343/846

* cited by examiner

*Primary Examiner*—Tan Ho
(74) *Attorney, Agent, or Firm*—Ton Hamill, Jr.

(57) ABSTRACT

A method to feed antennas proximal to a monopole antenna is shown. A monopole antenna is fed through a ground plane by a conventional means. A transmission feed line for an antenna proximal the monopole antenna passes through the ground plane and makes contact with the monopole antenna at some distance from the ground plane, this contact being made by a non-signal carrying conductor of the transmission line. In the special case of a coaxial feed transmission line, this non-signal carrying conductor is the outside of the outermost conductor of the coaxial feed line. After making contact with the monopole antenna the feed line then passes through or along the side of a monopole antenna to reach the antenna proximal to the monopole.

3 Claims, 4 Drawing Sheets

METHOD TO FEED ANTENNAS PROXIMAL A MONOPOLE

This application claims benefit to U.S. provisional application Ser. No. 60/157,121, filed Oct. 4, 1999.

BACKGROUND OF THE INVENTION

1. Field of the Invention

The present invention relates generally to antenna feed methods, and more particularly to antennas for transmitting and/or receiving electromagnetic energy. More particularly, the invention relates to a method to feed antenna(s) in close proximity to a monopole.

2. Description of the Prior Art

Monopole antennas are known in the art and described in numerous antenna texts. U.S. Pat. No. 4,814,777 issued to Monser teaches an antenna system comprising a vertical monopole antenna coupled to a first feed on a ground plane conductor and a dipole antenna comprising a plurality of horizontal dipole antenna elements coupled to a corresponding plurality of feeds on the ground plane conductor. The plurality of dipole antenna elements being disposed about the first feed. The vertical monopole antenna comprises a plurality of monopole antenna elements, the plurality of monopole antenna elements and the plurality of dipole antenna elements being alternately radially disposed about the first feed.

U.S. Pat. No. 3,739,390 issued to Poppe, et. al., teaches a dual antenna system including first and second antennas respectively capable of operating at first and second distinct frequency ranges. The antenna system taught comprises a coaxial transmission line having a central conductor and an outer conductor surrounding and insulated from the central conductor. The central conductor of Poppe has a section that extends axially beyond the outer conductor, at least a portion of which defines a radiating element of a first antenna. A pair of intersecting conductors coupled to the outer conductor of Poppe's antenna system extend radially for defining a first reference for element for a first antenna and also defining a radiating element of a second antenna. The pair of intersecting conductors serve as a load element for the outer element thus increasing the effective electrical length of the second antenna. A grounded sleeve surrounds and is insulated from the outer conductor and defines a second reference element for the second antenna. The inner conductor serves to feed one antenna and the outer conductor feeds the second antenna and the two antennas are fed from the same point from the ground plane.

U.S. Pat. No. 2,498,655 issued to Faymoreau, et. al. teaches an orientable antenna arrangement comprising a plurality of N superimposed antenna systems where N is the number of systems each rigidly mounted on a mast structure. The mast structure comprising in space a coaxially fixed relationship a vertical central conducting member and a plurality of coaxial tubular conducting members there being one more of the conducting members than there are antenna systems. The antennas taught by Faymoreau are each fed coaxially to each other through the same point in the ground plane.

SUMMARY OF THE INVENTION

A method to feed antennas proximal to a monopole antenna is shown. A monopole antenna is fed through a ground plane by a conventional means. A transmission feed line for an antenna proximal the monopole antenna passes through the ground plane and makes contact with the monopole antenna at some distance from the ground plane, this contact being made by a non-signal carrying conductor of the transmission line. In the special case of a coaxial feed transmission line, this non-signal carrying conductor is the outside of the outermost conductor of the coaxial feed line. After making contact with the monopole antenna the feed line then passes through or along the side of a monopole antenna to reach the antenna proximal to the monopole.

A feed method is defined herein as the method used to convey the signals from the transmitter to an antenna and to convey signals from an antenna to the receiver.

The feed method taught herein provides both a method of feeding antennas in the proximity of the monopole and helps a monopole to obtain a wider impedance bandwidth. This feed method is applicable to feeding any types of antennas that are in the proximity of a monopole. A balun and impedance matching circuit for the attached antenna, if needed, may be located either inside or outside the monopole. The specific type of monopole used is not pertinent, the monopole can be thin, thick, cage, conical, inverted conical, printed-circuit, or any other type of monopole. This method has been shown to work well with conical monopoles and inverted conical monopoles, both of solid and caged wire construction. For typical flared or conical monopoles the electrical contact point taught herein is typically located at more than 0.1 wavelength from the monopole feed point. At certain frequencies where a flared or conical monopole is approximately 0.15 wavelengths long, the presence of the electrical contact taught herein produces a higher input resistance for the monopole feed, hence assisting in impedance matching the monopole and allows the monopole height to be reduced.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will form the subject matter of the claims appended hereto.

In this respect, before explaining the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which this disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a method to feed antennas proximal to a monopole antenna.

It is also an object of the present invention to allow that antennas in close proximity to a monopole can be used with minimum degradation of performance of either the monopole or the other antennas.

It is a further object of the present invention to improve the impedance bandwidth performance of the monopole.

It is another object of the present invention to reduce the overall dimensions of the volume occupied by the antenna system, including the monopole.

It is an another object of the present invention to provide a feed method that is relatively easy to construct and results in extremely broadband performance of the antenna system.

It is another object of the present invention to obviate the need for costly, narrowband concentric coaxial feed structures for plural antennas.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein.

DESCRIPTION OF THE PREFERRED EMBODIMENT

With reference now to the drawings, a signal feed method for an antenna system including a first antenna in close proximity to a monopole antenna embodying the principles and concepts of the present invention will be described.

Figure 1:
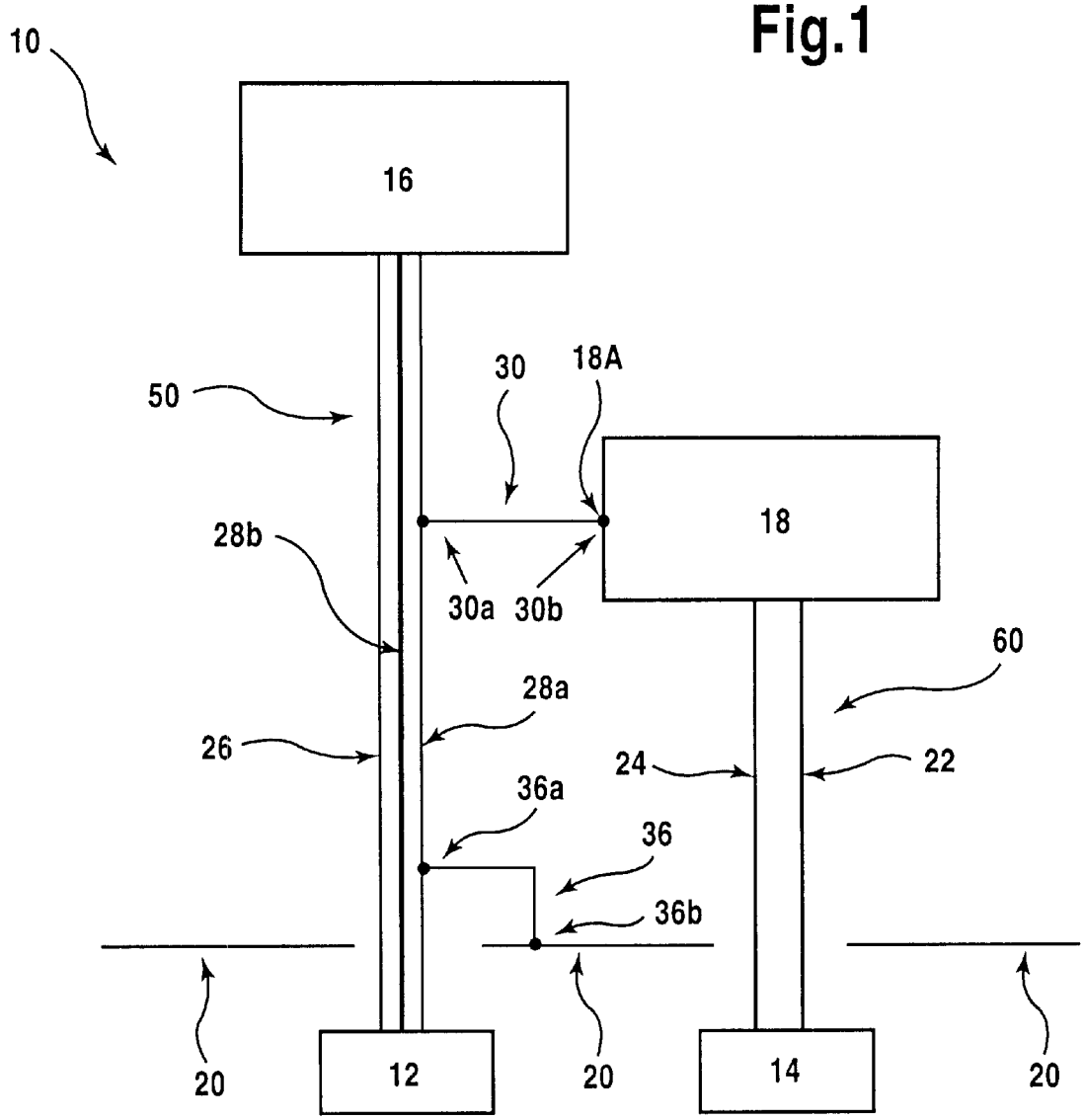
FIG. 1 is a block diagram of a method to feed an antenna system where the antenna system includes a first antenna in close proximity to a monopole antenna.

FIG. 1 is a block diagram showing an antenna system 10 comprised of a first antenna 16 in close proximity to a monopole antenna 18. The antenna 10 is shown with the ground plane 20. First antenna 16 is fed from first transmitter/receiver 12 by first transmission feed line 50 including a first signal carrying conductor 26, a second signal carrying conductor 28*b* and a first non-signal carrying conductor 28*a*. Monopole antenna 18 is fed from second transmitter/receiver 14 by second transmission feed line 60 including a third signal carrying conductor 22 and a fourth signal carrying conductor 24. Alternatively, monopole antenna 18 may be fed by any conventional means through the ground plane. First electrical conductor 30 connects the monopole antenna 18 to the surface of the first non-signal carrying conductor 28*a* which feeds the first antenna 16. The first electrical conductor 30 is connected from first contact point 30*b* on the monopole antenna 18 to second contact point 30*a* on the first non-signal carrying conductor 28*a*. The non-signal carrying conductor 28*a* is connected to the ground plane 20 by electrical conductor 36. The electrical conductor 36 is connected to the non-signal carrying conductor 28*a* at a third contact point 36*a* and to the ground plane 20 at a fourth contact point 36*b*. First electrical connector 30 and second electrical connector 36 need not be of visible length but may be solder or other convenient means of electrical contact. Circuits for baluns, impedance matching, and phasing may be inserted between first conductor 26, second conductor 28*b* and first antenna 16 if needed for feeding first antenna 16.

If the type of transmission line feeding antenna 16 does not provide a non-signal carrying conductor 28*a,* an additional conductor should be inserted to connect points 30*a* and 36*a*. This additional conductor does not need to extend to first antenna 16.

Figure 2:
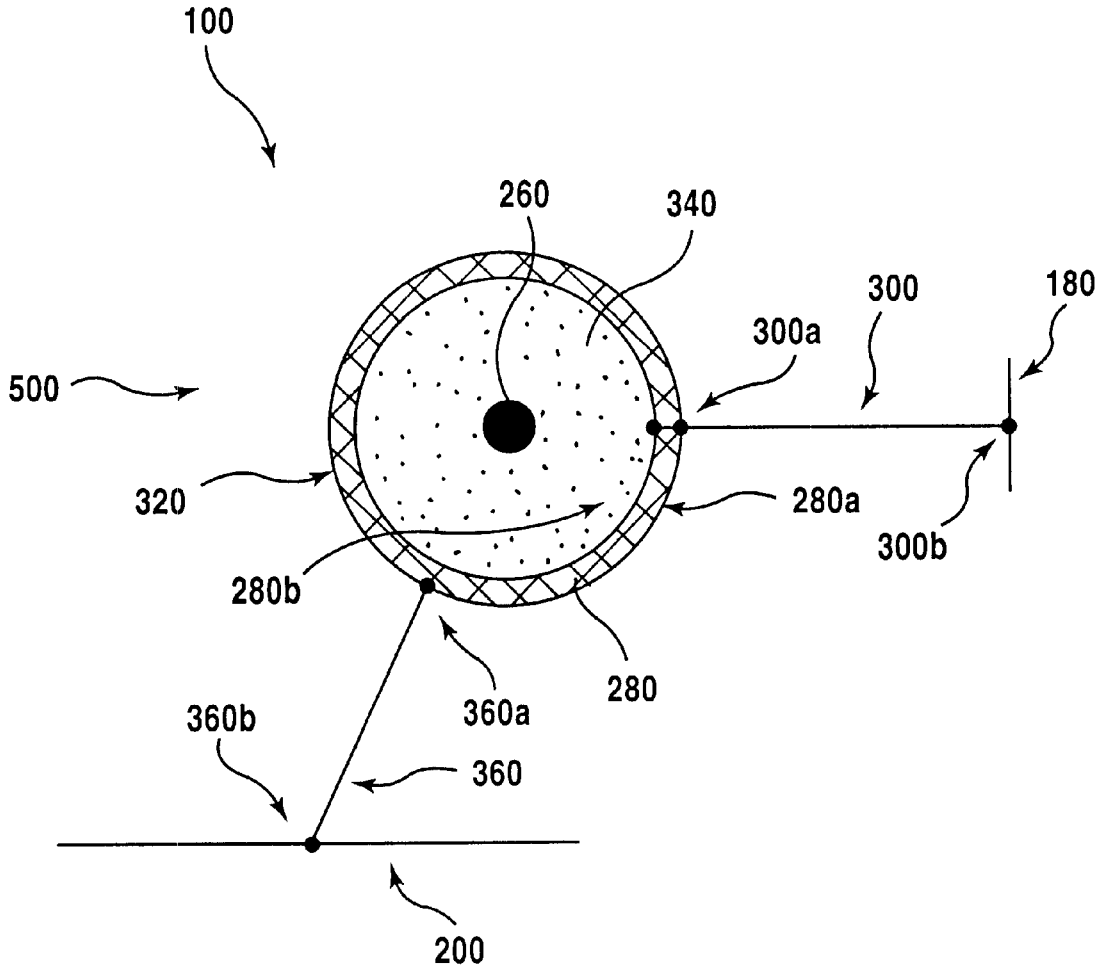
FIG. 2 is a close-up diagram of the method illustrated in FIG. 1 showing a cross-sectional slice through a two conductor coaxial feed transmission line, it's relation to a monopole and to a ground plane.

FIG. 2 is an example of the antenna system 100 where the feed transmission line 500 to the first antenna is a coaxial cable 320. The antenna system 100 includes a first antenna (not shown), a monopole antenna and a ground plane. A small portion of the monopole antenna is shown at 180 and a small portion of the ground plane is shown at 200. The coaxial cable 320 is shown in cross section and shows how it is connected to the monopole antenna 180 and the ground plane 200. The coaxial cable 320 includes a layer of insulation 340 intermediate an inner signal carrying conductor 260 and an outer conductor 280. The monopole antenna 180 is fed by conventional means and is specifically not fed by feed transmission line 500. Outer conductor 280 has a signal carrying inner surface 280*b* and a non-signal carrying outer surface 280*a*. The first electrical connector 300 connects the non-signal carrying outer surface 280*a* to monopole antenna 180. The first electrical conductor 300 is connected from first contact point 300*b* on the monopole antenna 180 to second contact point 300*a* on the non-signal carrying conductor 280*a*. The non-signal carrying conductor 280*a* is connected to the ground plane 200 by a second electrical conductor 360. The second electrical conductor 360 is connected to the non-signal carrying conductor 280*a* at a third contact point 360*a* and to the ground plane 200 at a fourth contact point 360*b*. First electrical connector 300 and second electrical connector 360 need not be of visible length but may be of solder or other conventional means of electrical contact. After contacting the monopole at 300*b* coaxial cable 320 may pass either into the monopole antenna 180 or it may pass along the outside of the monopole antenna 180.

Figure 3:
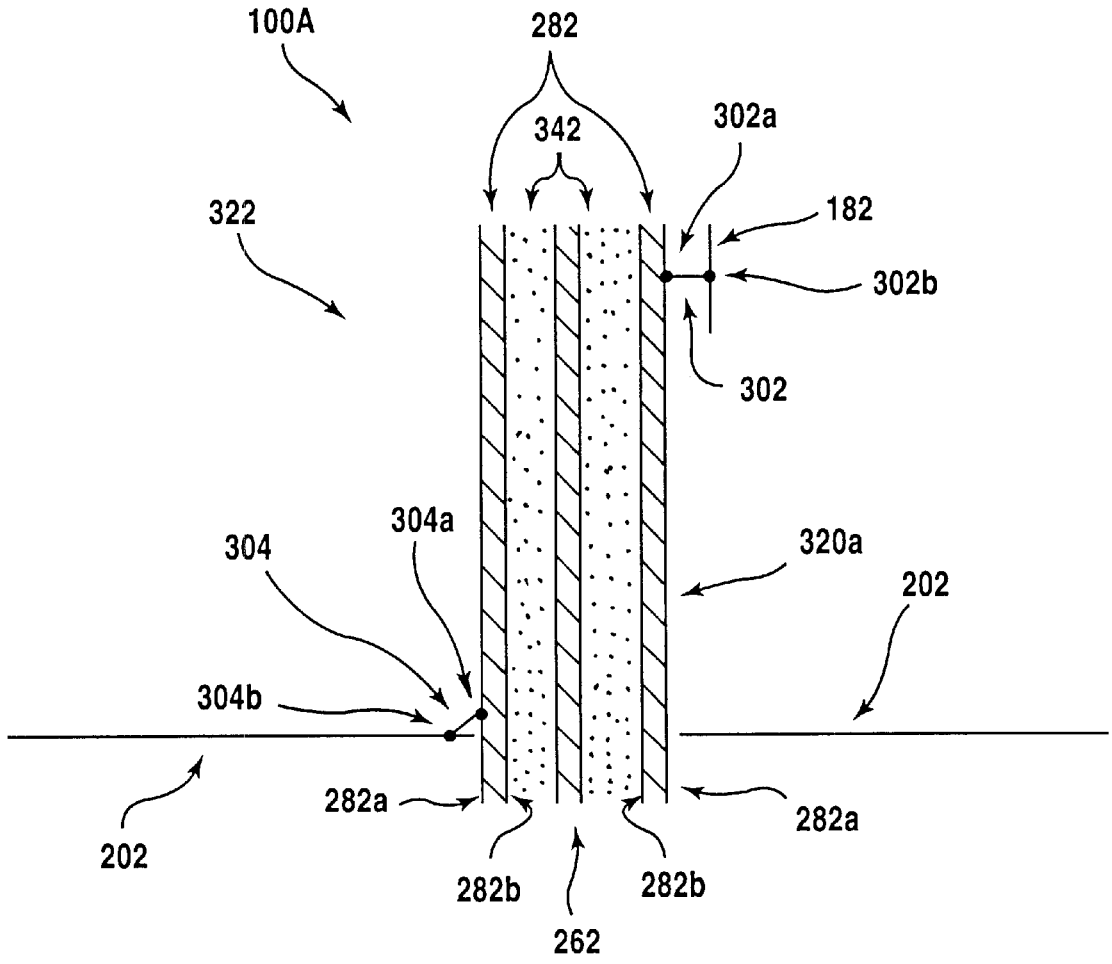
FIG. 3 is a close-up diagram of the method illustrated in FIGS. 1 and 2, showing a longitudinal slice through a two conductor coaxial feed transmission line, it's relation to a monopole and to a ground plane.

FIG. 3 is a second view of the antenna system 100*a* where the feed transmission line 322 is a coaxial cable 320*a*. The antenna system 100*a* includes a first antenna (not shown) and a monopole antenna. A small portion of the monopole antenna is shown at 182 and a small portion of the ground plane is shown at 202. The coaxial cable 320*a* or feed transmission line 322 has insulation intermediate an inner conductor 262 and an outer conductor 282. Outer conductor 282 has an inner surface 282*b* and an outer surface 282*a*. First electrical conductor 302 makes connection with the outer surface 282*a* of the outer conductor 282 at first contact point 302*a*. First electrical conductor 302 is also connected with the monopole antenna 182 at second contact point 302*b*. Second electrical conductor 304 makes connection with the outer surface 282*a* at third contact point 304*a*. Second electrical conductor 304 is also connected to the ground plane 202 at fourth contact point 304*b*. First electrical connector 302 and second electrical connector 304 need not be of visible length but may be solder or other conventional means of electrical contact. After contacting the monopole at 302*b,* coaxial cable 322 may pass either into monopole antenna 182 or it may pass along the outside of monopole antenna 182.

Figure 4:
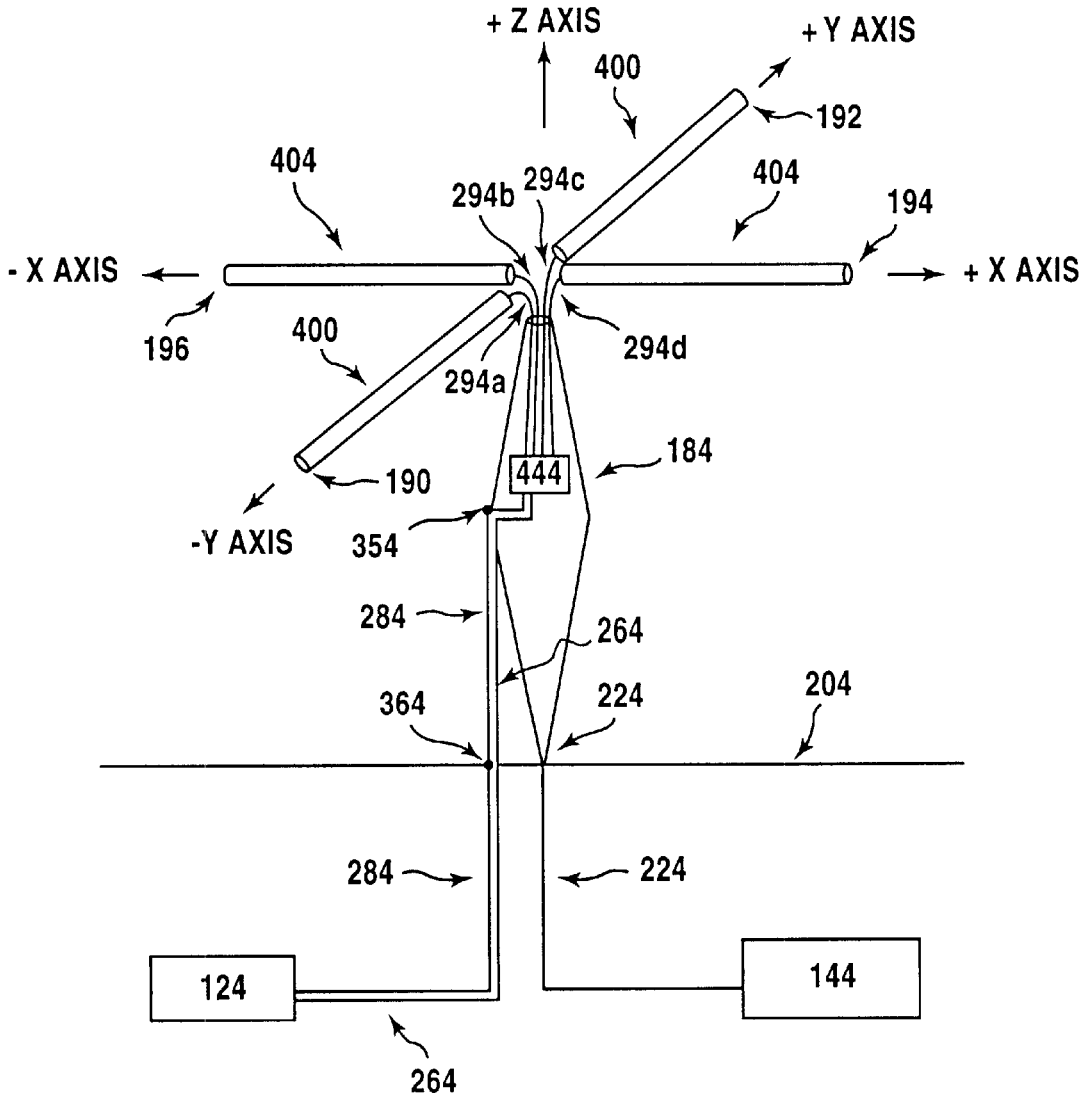
FIG. 4 illustrates an example of the instant invention employing a pair of crossed dipole antennas orthogonal to a conical monopole antenna and parallel to a ground plane.

FIG. 4 is the antenna system of the instant invention employing a monopole 184 with a pair of crossed dipoles 400, 404 respectively. Monopole antenna 184 is fed via any conventional means by feed transmission line 224 from transmitter/receiver 144. Monopole 184 is illustrated to be a conical monopole. In this example, the first antenna is chosen to be a pair of crossed dipole antennas 400 and 404, these antennas being in close proximity to monopole 184. The crossed dipoles in this example are orthogonal to each other and parallel to the ground plane 204 but this is not a requirement of the invention. Crossed dipole antennas 400 and 404 are fed from transmitter/receiver 124 via signal carrying feed lines at 264, and non-signal carrying conductor 284. Non-signal carrying conductor 284 contacts the monopole surface at electrical contact point 354 via solder or any convenient means. Feed lines 264 enter monopole 184 near contact point 354. Non-signal carrying conductor 284 may also enter monopole near contact point 354. Said contact point may be at a distance, on monopole 184, from ground plane 204 of about 0.1 or more wavelengths of the lowest frequency to be employed. When monopole 184 provides sufficient interior space, then baluns, phasing, and impedance matching circuits 444 may be deployed inside the monopole as required to assist in feeding the dipoles, 400 and 404. Circuits at 444 may or may not be needed and may also be located outside of monopole 184. Transmission feed lines 264 from transmitter/receiver 124 connect to circuits 444 whence they are divided into separate feed lines. Feed line 294*a* feeds dipole element 190 of dipole 400; feed line 294*c* feeds dipole element 192 of dipole 400; feed line 294*d* feeds dipole element 194 of dipole 404; feed line 294*b* feeds dipole element 196 of dipole 404.

It is apparent from the above that the present invention accomplishes all of the objectives set forth by providing a method to feed antennas close to a monopole such that antennas in close proximity to a monopole can be used with minimum degradation of performance of either the monopole or the other antennas and that the impedance bandwidth performance of the monopole is achieved whilst reducing the overall dimensions of the volume occupied by the antenna system, including the monopole.

With respect to the above description, it should be realized that the optimum dimensional relationships for the parts of the invention, to include variations in size, materials, shape, form, function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

I claim:

1. An antenna system including a ground plane comprising:

a) a first antenna, said first antenna having a first transmission feed line, said first transmission feed line including a non-signal carrying conductor, b) a monopole antenna, fed through said ground plane, c) a first electrical connection means, said first electrical connection means connecting said monopole antenna to said non-signal carrying conductor, d) a second electrical connection means, said second electrical connection means connecting said non-signal carrying conductor to said ground plane.

2. An antenna system including a ground plane comprising:

a) a first antenna, said first antenna having a first transmission feed line, said first transmission feed line comprised of a first signal carrying conductor, a second signal carrying conductor and a non-signal carrying conductor, b) a monopole antenna, fed through said ground plane, c) a first electrical connection means, said first electrical connection means connecting said monopole antenna to said non-signal carrying conductor, d) a second electrical connection means, said second electrical connection means connecting said non-signal carrying conductor to said ground plane.

3. An antenna system including a ground plane comprising:

a) a first antenna fed through said ground plane, said first antenna having a first transmission feed line, said first transmission feed line including a first signal carrying conductor, a second signal carrying conductor and a non-signal carrying conductor, b) a monopole antenna, said monopole antenna fed through said ground plane, c) a first electrical connection means, said first electrical connection means electrically connecting said monopole antenna to said non-signal carrying conductor, d) a second electrical connection means, said second electrical connection means electrically connecting said non-signal carrying conductor to said ground plane.

* * * * *